US010000873B2

(12) United States Patent
Schmitz

(10) Patent No.: US 10,000,873 B2
(45) Date of Patent: Jun. 19, 2018

(54) APPARATUS FOR THE TREATMENT OF STRAND-LIKE TEXTILE MATERIAL

(71) Applicant: FONG'S EUROPE GMBH, Schwäbisch Hall (DE)

(72) Inventor: Johannes Schmitz, Coesfeld (DE)

(73) Assignee: FONG'S EUROPE GMBH, Schwäbisch Hall (DE)

( * ) Notice: Subject to any disclaimer, the term of this patent is extended or adjusted under 35 U.S.C. 154(b) by 69 days.

(21) Appl. No.: 15/024,351

(22) PCT Filed: Sep. 20, 2014

(86) PCT No.: PCT/EP2014/070063

§ 371 (c)(1),
(2) Date: Mar. 23, 2016

(87) PCT Pub. No.: WO2015/040198

PCT Pub. Date: Mar. 26, 2015

(65) Prior Publication Data

US 2016/0215427 A1 Jul. 28, 2016

(30) Foreign Application Priority Data

Sep. 23, 2013 (DE) ..... 10 2013 110 491

(51) Int. Cl.
*D06B 3/28* (2006.01)
*D06B 23/14* (2006.01)

(52) U.S. Cl.
CPC ..... *D06B 3/28* (2013.01); *D06B 23/14* (2013.01)

(58) Field of Classification Search
None
See application file for complete search history.

(56) References Cited

U.S. PATENT DOCUMENTS 3,690,128 A 9/1972 Biesinger
4,210,005 A * 7/1980 Trullas ..... D06B 3/26 68/148

(Continued)

FOREIGN PATENT DOCUMENTS

DE 2207679 A1 8/1973
DE 7722911 U1 11/1977

(Continued)

OTHER PUBLICATIONS

International Search Report (ISR) and Written Opinion (WO) dated Dec. 18, 2014 issued in International Application No. PCT/EP2014/070063.

(Continued)

*Primary Examiner* — Jason Y Ko
*Assistant Examiner* — Cristi J Tate-Sims
(74) *Attorney, Agent, or Firm* — Holtz, Holtz & Volek PC

(57) ABSTRACT

An apparatus for treatment of a strand-like textile material in the form of a continuous material rope, which is circulated during at least part of the treatment, includes: an elongated, essentially tubular treatment container; a transport nozzle array to which a transport medium flow can be applied; and a transport section adjoining the transport nozzle array. The transport section terminates on a material rope inlet side in a storage section of the treatment container. The storage section accommodates a folded material rope pile and includes: a gliding bottom extending at a distance above a container wall below, the gliding bottom extending from the material rope inlet side of the storage section to a material rope outlet side in vicinity of the transport nozzle array; and at least one unit provided for changing an inclination of the gliding bottom from the material rope inlet side toward the material rope outlet side.

25 Claims, 12 Drawing Sheets

(56) References Cited

U.S. PATENT DOCUMENTS

Figure 1:
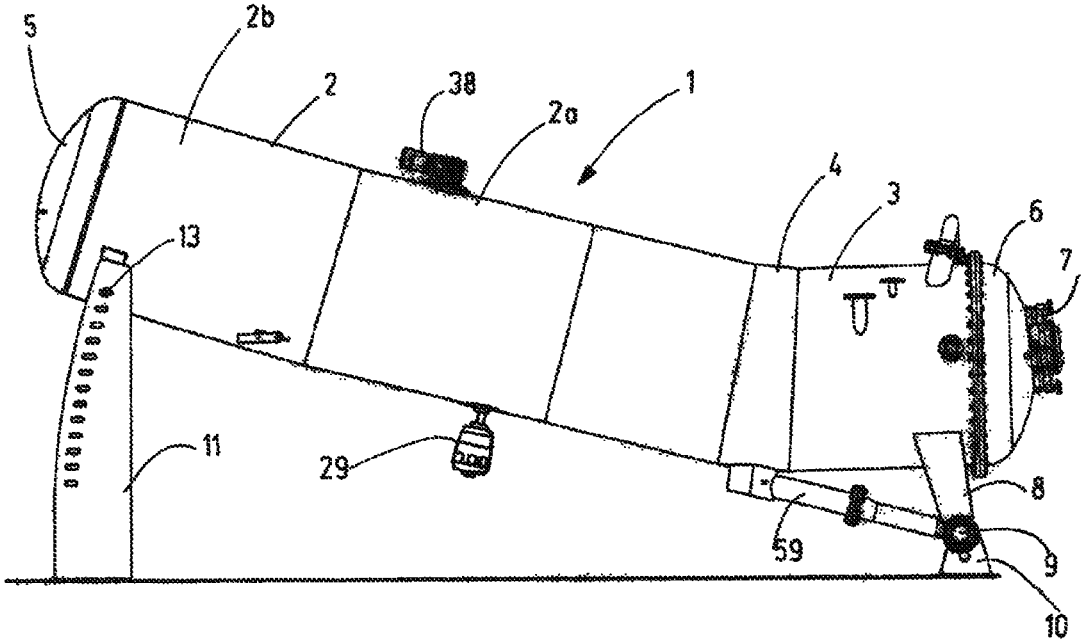

| | | | | |
|---|---|---|---|---|
| 4,392,365 | A | 7/1983 | Miyamoto et al. | |
| 4,825,491 | A | 5/1989 | Miyamoto et al. | |
| 5,235,828 | A | 8/1993 | Aurich et al. | |
| 5,850,651 | A | 12/1998 | Ishimaru et al. | |
| 8,746,018 | B2 | 6/2014 | Christ | |
| 2006/0253999 | A1 | 11/2006 | Christ et al. | |
| 2008/0263782 | A1* | 10/2008 | Christ | D06B 3/28 8/149.1 |
| 2010/0175200 | A1* | 7/2010 | Christ | D06B 3/28 8/152 |

FOREIGN PATENT DOCUMENTS

| | | | | |
|---|---|---|---|---|
| DE | 3613364 | A1 | 2/1987 | |
| DE | 102007036408 | B3 | 12/2008 | |
| EP | 0080424 | A1 | 6/1983 | |
| EP | 0531868 | A1 * | 3/1993 | D06B 3/206 |
| EP | 1722023 | A2 | 11/2006 | |
| FR | 2667332 | A3 | 4/1992 | |
| FR | 2681364 | A1 | 3/1993 | |
| GB | 2031969 | A | 4/1980 | |
| JP | 07305261 | A | 11/1995 | |
| TW | M440978 | U | 11/2012 | |
| WO | 0173180 | A1 | 10/2001 | |

OTHER PUBLICATIONS

European Office Action dated Jul. 10, 2017 issued in counterpart European Application No. 14767038.4.

Taiwanese Office Action and Search Report (and partial English translation thereof) dated Feb. 17, 2017 issued in counterpart Taiwanese Applicaiton No. 102141685.

* cited by examiner

APPARATUS FOR THE TREATMENT OF STRAND-LIKE TEXTILE MATERIAL

The invention relates to an apparatus for the treatment of strand-like textile material in the form of a continuous material rope which is circulated during at least part of its treatment.

So-called long storage machines are widely used in discontinuous single piece finishing for finishing and generally treating synthetic strand-like textile material, in particular. These long storage machines comprise an elongated, substantially tubular treatment container and a transport nozzle array arranged therein, to which transport nozzle array can be applied a liquid and/or gaseous transport medium flow. Adjoining the transport nozzle array is a transport section that terminates at a material rope inlet side in a storage section of the treatment container accommodating a folded rope pile. The storage section comprises a gliding bottom extending at a distance above the container wall located below, said gliding bottom extending from the material rope inlet side of the storage section to a material rope outlet side near the transport nozzle array.

Examples of such long storage machines are described in publications DE 2 207 679 A, DE 36 13 364 C2, DE 10 2007 036 408 B3 and FR 2 681 364, to mention only a few examples. As a rule, these machines are processed in a floating manner at a relatively high bath ratio (1:8 to 1:2) in the treatment bath. The material rope drive comprises a reel and a transport nozzle. In many cases the reel is a source of material damage resulting in dragging points or fabric displacement. This is due to low contact forces between the material rope and the reel as well as due to smooth reel surfaces; and, due to a fluid film between the material rope and the reel, the pulling action of the reel is frequently more likely rather minimal. Furthermore, the coordination of the material rope velocity generated by the transport nozzle and the reel circumferential speed is a problem in many cases. With the use of reels that are freely moving in material rope transport direction, it is attempted to reduce surface damage to the treated textile material caused by the decelerating effect of the reel.

A long storage machine is also known from publication U.S. Pat. No. 5,850,651, wherein a reel is omitted in one embodiment and the drive of the circulating material rope is achieved by air or an air/fluid mixture as the transport medium with which a transport nozzle can be loaded. A design of a long storage machine that, in principle, is similar is known from publication JP 07 305261 A. This machine also operates without a reel. The material transport is accomplished by a transport nozzle array that is optionally operated with gaseous and/or fluid transport media. Machines having this design can do with a relatively low draw-off height, along the length of which the material rope must be lifted at the outlet of the material storage section up to its entry into the transport nozzle. In so doing, the pulling forces exerted on the circulating material rope are appropriately lower in this region, this being advantageous in the treatment of sensitive textile materials.

In the elongated substantially tubular treatment container of long storage machines, there is provided, adjoining the material rope inlet, a storage section accommodating the folded rope pile. As a rule, the storage section comprises a gliding bottom for the material rope pile at a distance from the container wall located below, in which case—between the gliding bottom and the transport section—folding means for the material rope may also be arranged, as has been described in the aforementioned DE 10 2007 036 408 B3.

The gliding bottom that comes into contact with the upper side of the material rope pile and is preferably configured so as to be friction-minimizing is inclined obliquely downward—at least in sections—from the folding means on the materials rope inlet side toward the material rope outlet side of the storage section in order to achieve a force of gravitation promoting the transport of the folded material rope.

However, in the course of a treatment the coefficient of friction of a textile material and thus of a material rope pile experiences changes that are caused, e.g., by the temperature, the material velocity and by different dyes, chemicals and auxiliary agents in the treatment bath. Thus, a decreasing coefficient of friction frequently causes the material pile compression toward the other end of the sliding bottom acting as the material pile slide to become increasingly greater and to finally be potentially up to 30%. As of a certain compression the material pile pressure can become so great that the textile material escapes upward in the direction out of the material rope pile and is pushed up. This behavior results in unfavorable draw-off properties at the draw-off point upstream of the material rope transport system. In order to remedy this, the sliding bottom was already configured in a concavely arcuate manner—at least in some regions—in longitudinal direction of the gliding bottom, in which case different profile forms have become known that, however, as a rule, are more or less well-suitable for only one specific type of material. Certain textile materials that contain, for example, cotton, polyamide, nylon, etc., have—depending on type of make, material composition and the like—coefficients of friction that may be within an entire band width with the result that also the material rope movement through the storage section of the machine may become problematic. It may occur that material rope loops are folded over and that material rope twists or material rope knots may form. Also, the packing density on the gliding bottom in the event of articles with increased inclination may lead to disadvantageous results due to temperature-related fold or crease formation.

It is the object of the invention to remedy this and provide a long storage machine that is uniformly suitable for the treatment of textile materials, i.e., substrates exhibiting different coefficients of friction and, consequently, make possible their use in a broad spectrum of applications of various textile material articles.

In order to achieve this object, the long storage machine according to the invention exhibits the features of patent claim 1.

The new long storage machine comprises means for changing the inclination of the gliding bottom from its material rope inlet side toward its material rope outlet side. This may be accomplished in such a manner that the gliding bottom inside the treatment container can be adjusted regarding its inclination. However, in a preferred embodiment the arrangement is such that the treatment container is supported so as to be rotatable about an axis of rotation and that it is allocated adjustment means by means of which said container can be locked in the respective angular position.

As a result of this, the inclination of the gliding bottom is no longer fixed at a defined value due to design specifications in the storage section of the treatment container but is adjustable, thus allowing easy consideration of the coefficients of friction of different textile materials.

The adjustment range of inclination of the gliding bottom and thus the height of the gliding angle specified for the material rope pile placed on the gliding bottom is—as a rule—between 6 to 14 degrees; however, larger angular ranges are also conceivable.

In order to facilitate passage of the material rope through the storage section of the treatment container and to increase the options of use of the machine, it is expedient for the gliding bottom to be configured in the manner of an elongated tub whose bottom is concavely curved—at least in some regions. In so doing, the bottom may be curved—at least in some regions—in the form of a circular arc or of a catenary line.

During the treatment of certain, highly sensitive textile materials the compressive pressure occurring in the material rope pile at the lower end, i.e., at the material rope outlet of the inclined gliding bottom, may already be too high with an otherwise common inclination of the gliding bottom so that folds, creases or other surface impairments occur. Considering this group of materials, the inclination of the gliding bottom may be reduced to such an extend that the tub formed by the gliding bottom is oriented essentially in horizontal direction. If at least the part of the tub over which the material rope glides is filled with treatment fluid, the textile material is treated in a floating manner; in other words, the treatment is performed as in a trough or tub in which the material floats in the fluid.

The new long storage machine works without reel, so that a very small draw-off height results for the material rope on the path from the material rope outlet of the storage section to the venturi transport nozzle array. This distance may be less than 0.5 meters and less which, in conjunction with a low fluid load of the material rope, results in low tensile stress on the material rope when it is being drawn off out of the storage section and thus results in an extremely gentle treatment of the textile material. This low tensile stress on the textile material results in a reduced elongation and thus in improved shrinkage values. An inward rolling of the material edges as occasionally occurs in elastane-containing articles is largely avoided.

Figure 2:
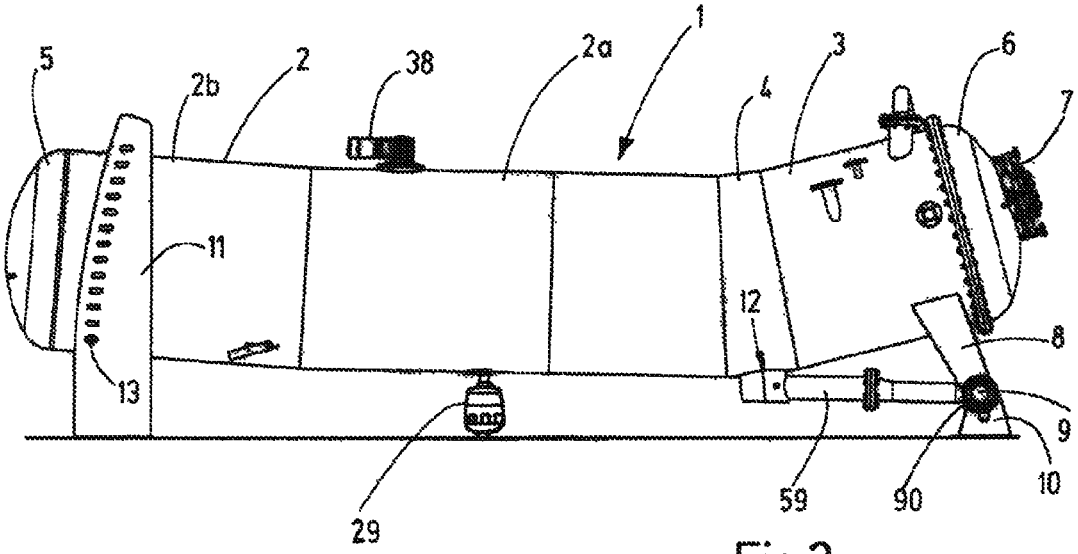
Figure 3:
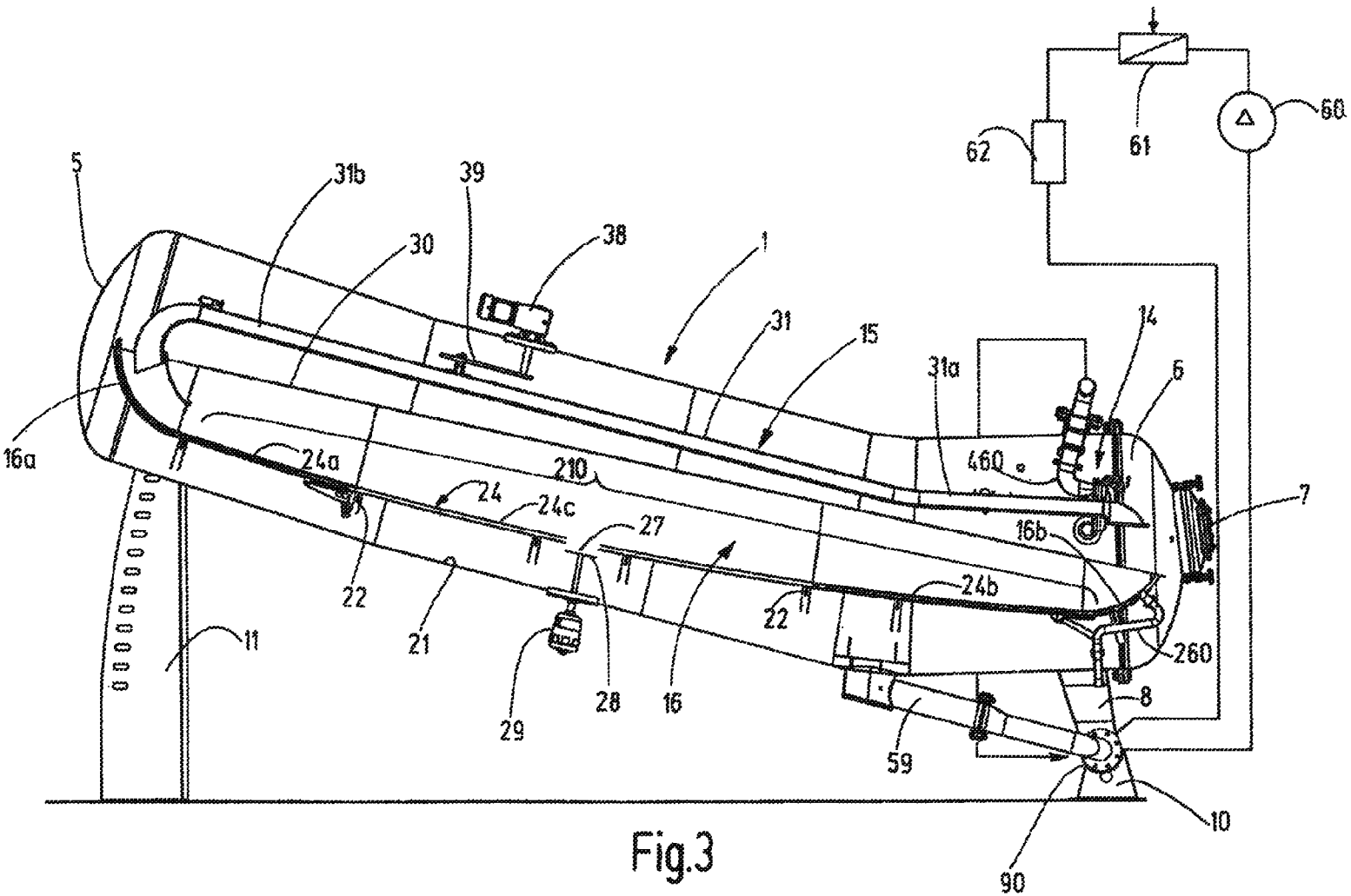
Figure 4:
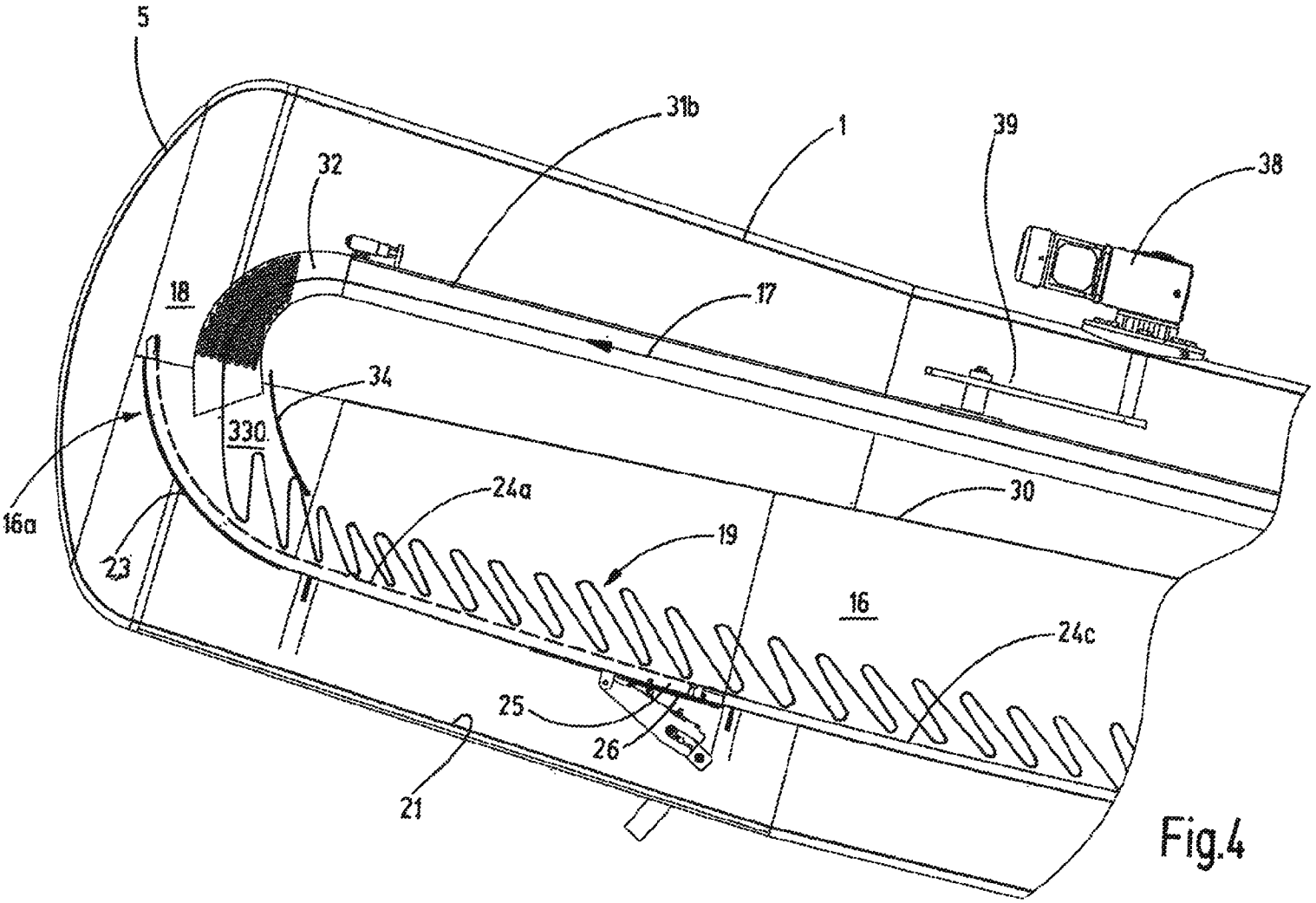
Figure 5:
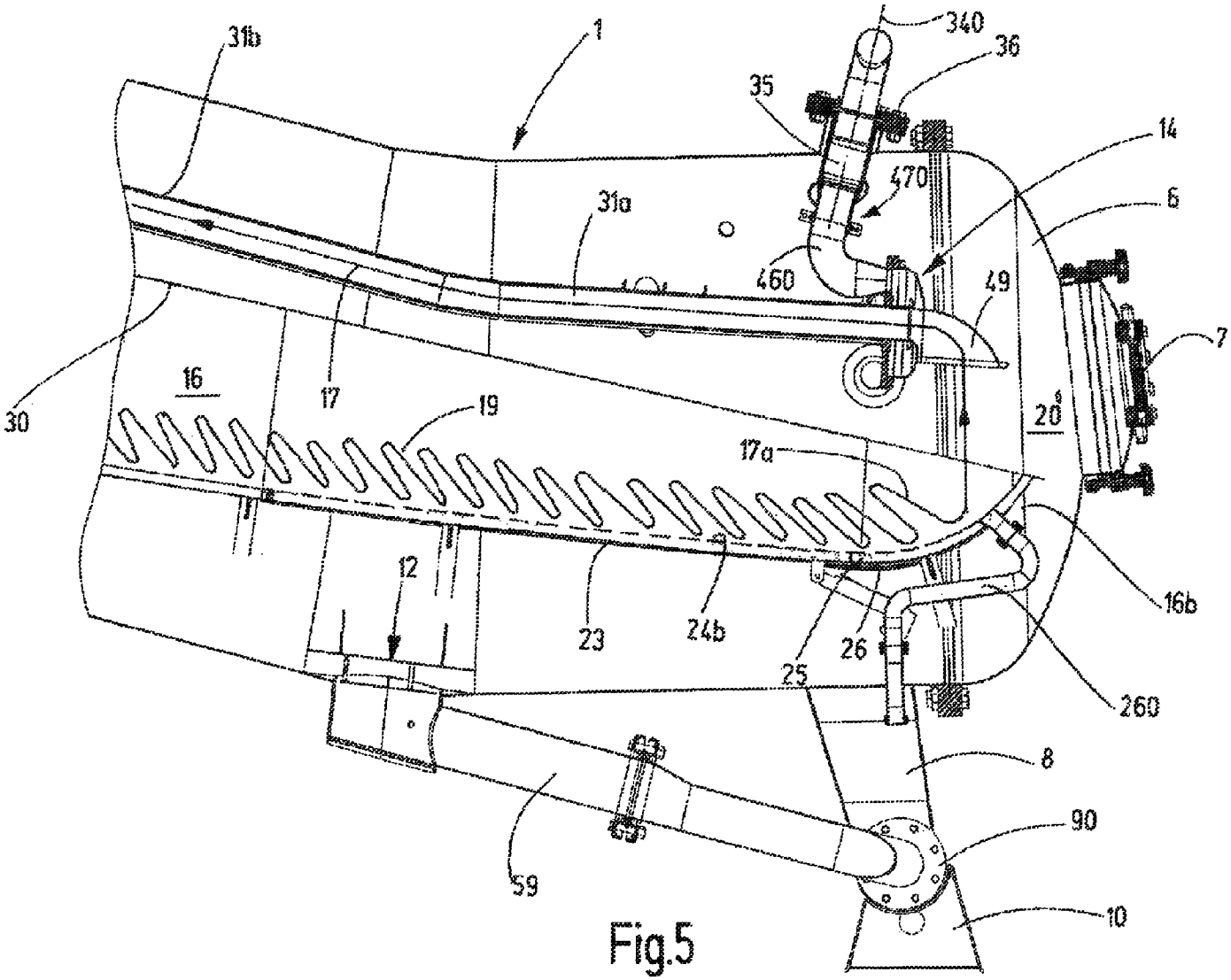
Figure 6:
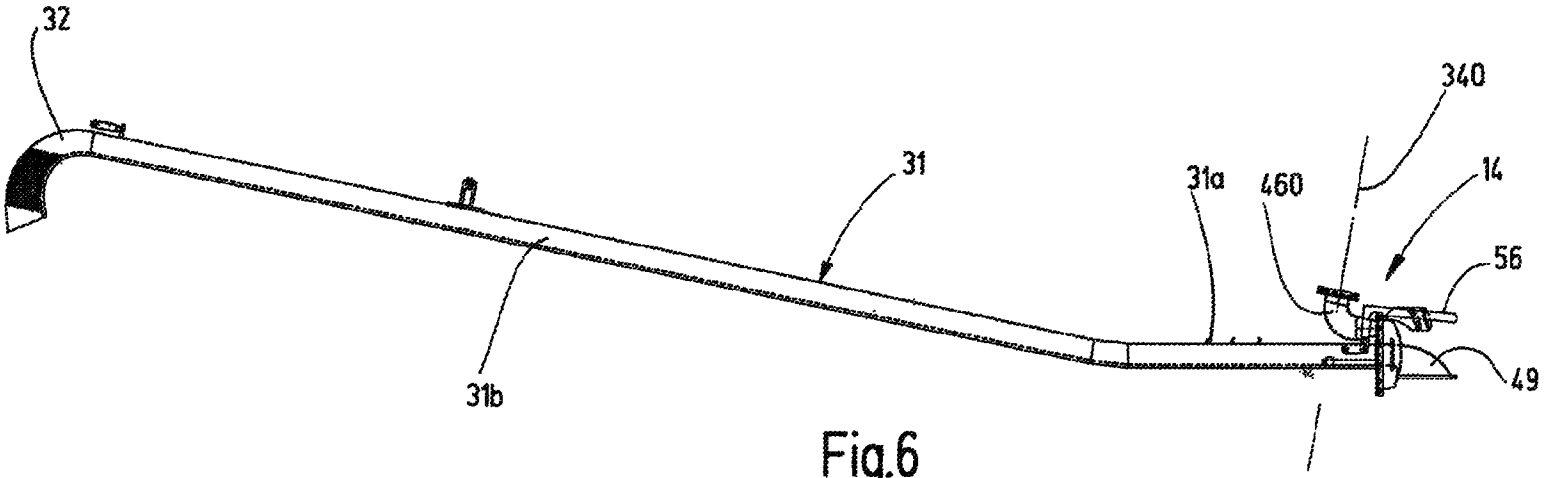
Figure 7:
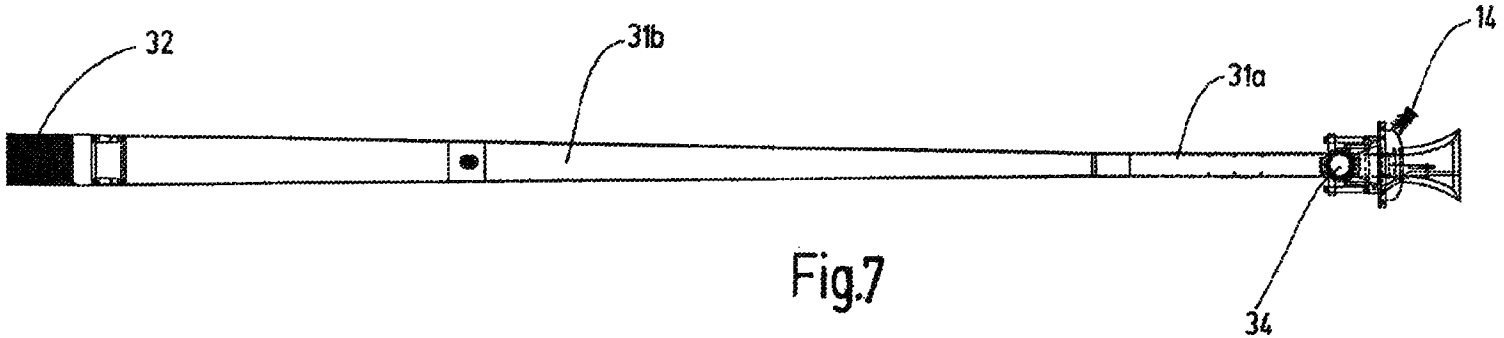
Figure 8:
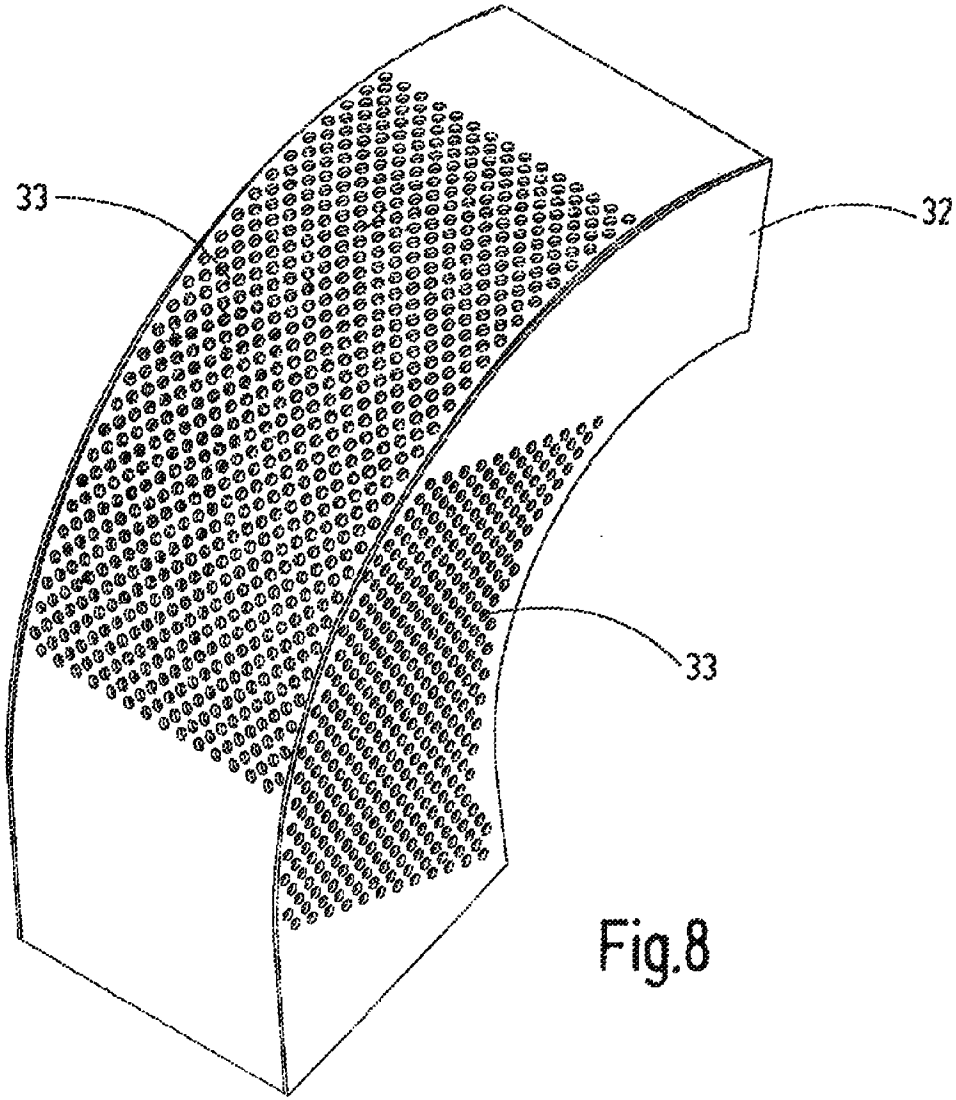
Figure 9:
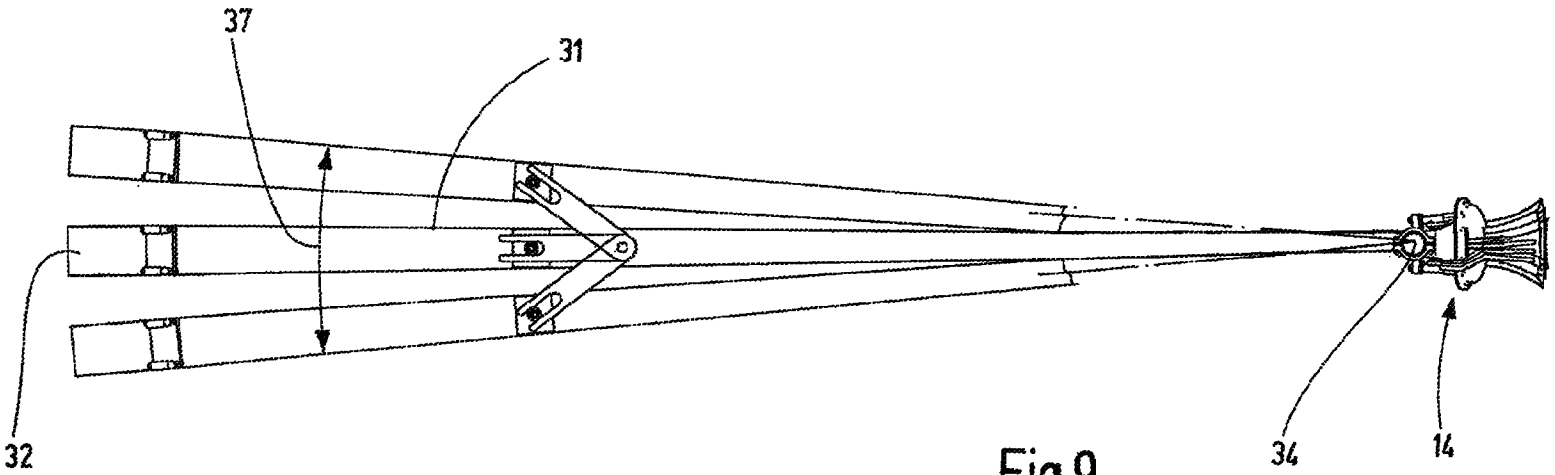
Figure 10:
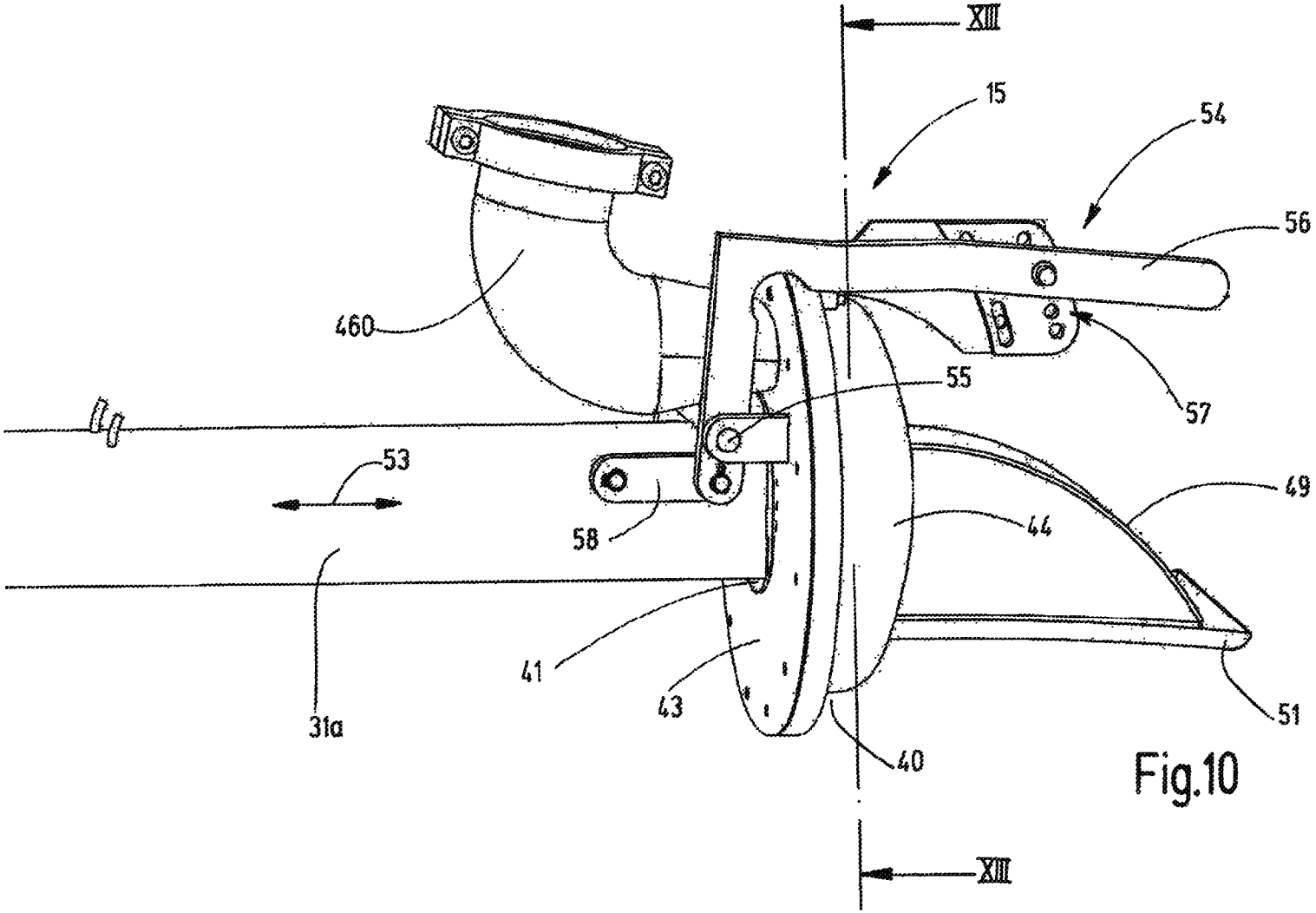
Figure 11:
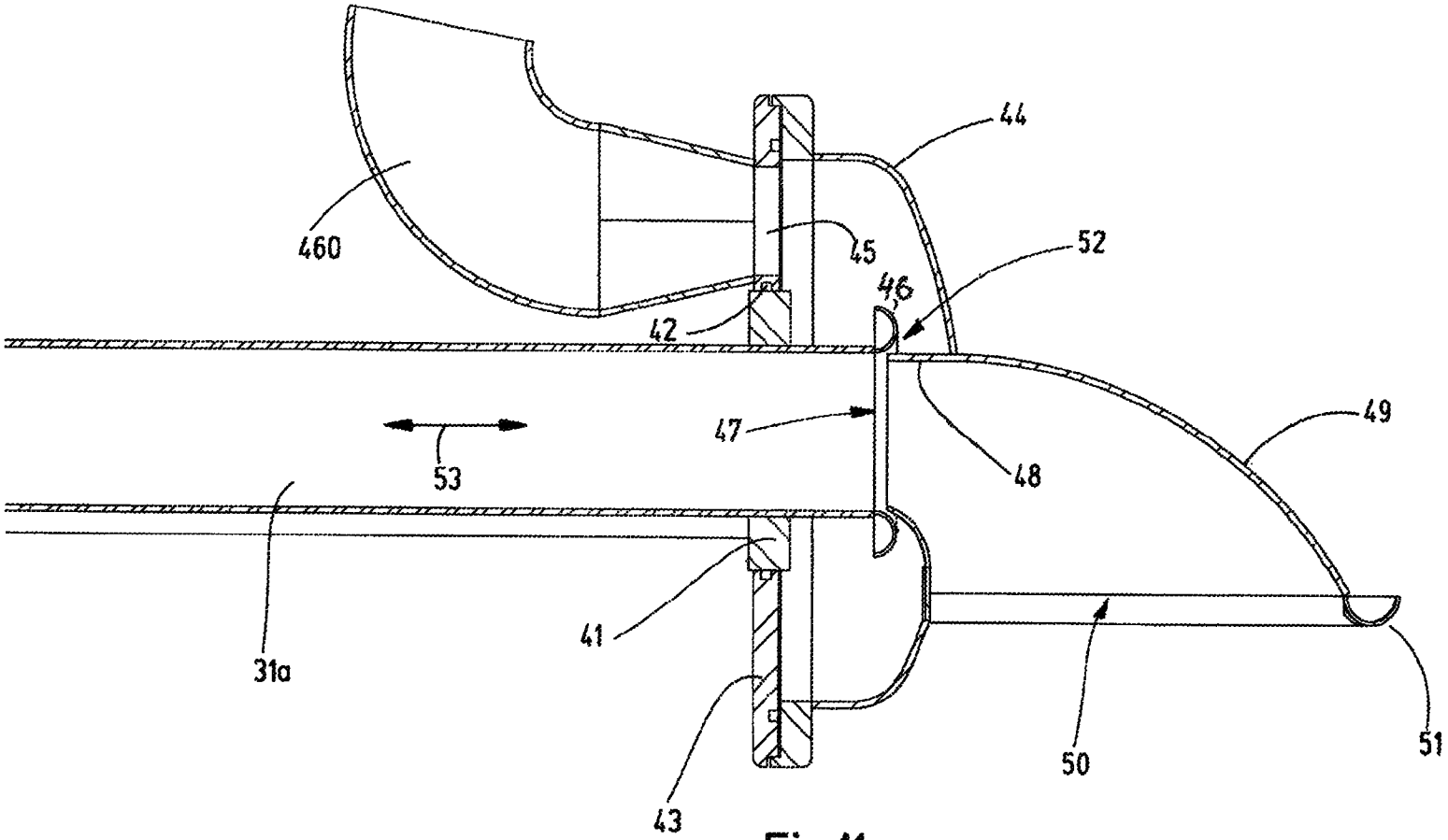
Figure 12:
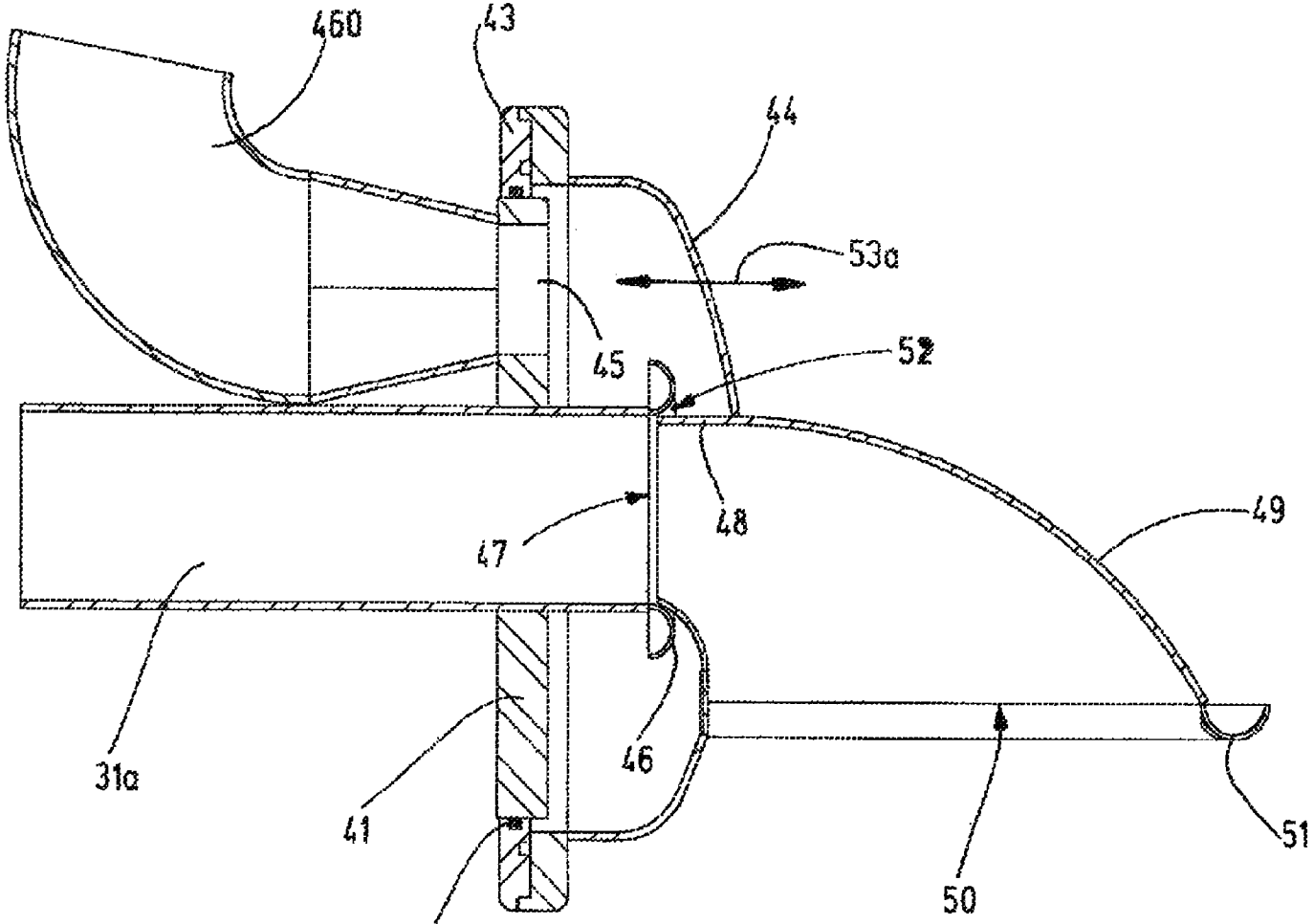
Figure 13:
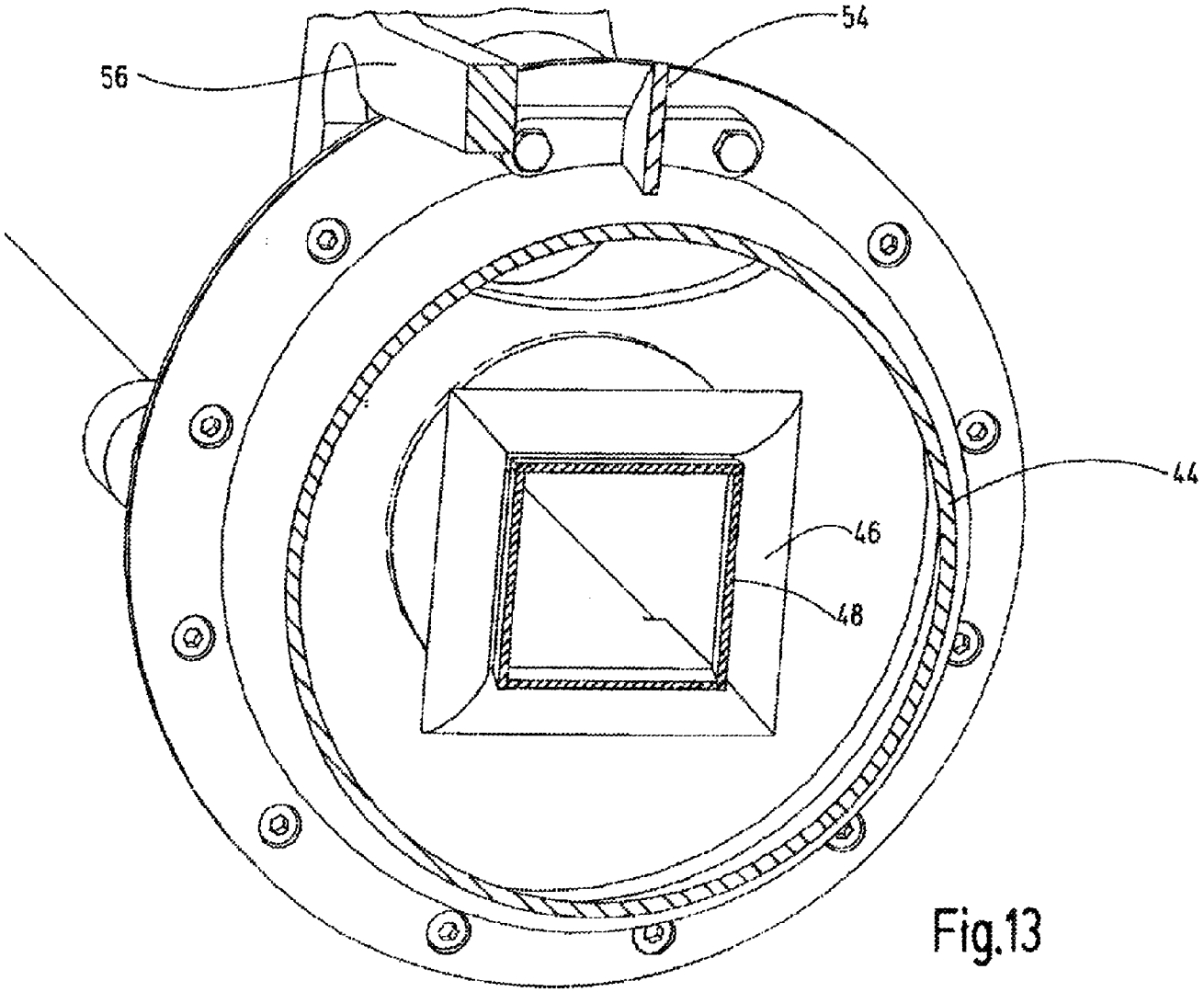
Figure 14:
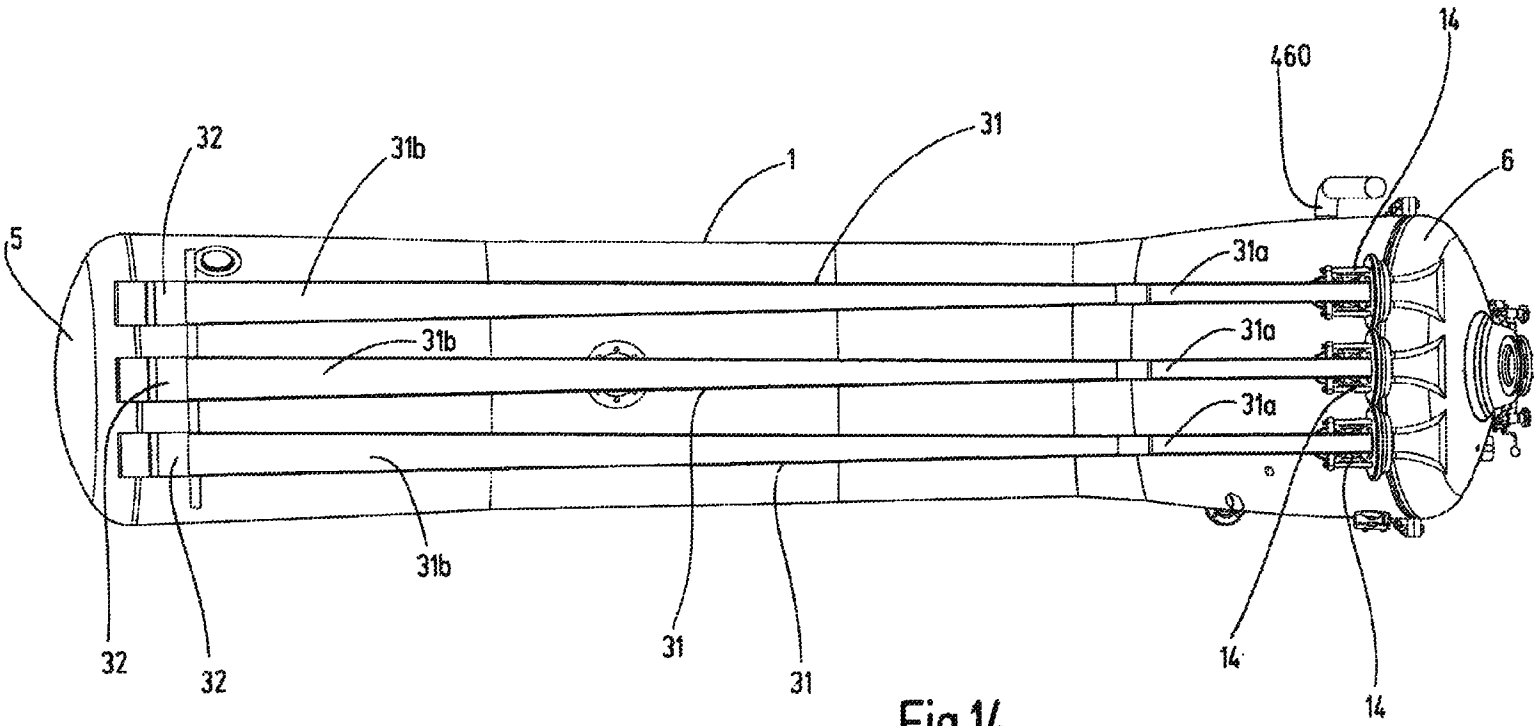

Additional advantageous features and embodiments of the invention are the subject matter of dependent claims. The drawings show exemplary embodiments of the subject matter of the invention. They show in FIG. 1 a schematic representation of a long storage machine, in a side elevation, with the treatment container tilted up;

FIG. 2 a corresponding side elevation of the long storage machine as in FIG. 1, with the treatment container lowered;

FIG. 3 a longitudinal section of the long storage machine as in Figure in, in a side elevation;

FIG. 4 a cutout of the long storage machine as in FIG. 3, in an enlarged side elevation, illustrating the material rope inlet side of the storage section;

FIG. 5 a cutout of the long storage machine as in FIG. 3, in an enlarged side elevation, illustrating the material rope outlet side of the storage section;

FIG. 6 a side elevation of the transport section of the long storage machine as in FIG. 2, in a different scale;

FIG. 7 a plan view of the transport section as in FIG. 6;

FIG. 8 a perspective partial representation of the material rope outlet elbow of the transport section as in FIG. 6, in a different scale;

FIG. 9 a plan view of the transport section as in FIG. 7, illustrating the pivot range of the transport tube;

FIG. 10 a perspective partial representation of the transport nozzle array of the long storage machine as in FIG. 2, in a different scale;

FIG. 11 a schematic longitudinal section, along line XI-XI of FIG. 10, of the transport nozzle array as in FIG. 10;

FIG. 12 the transport nozzle array as in FIG. 11 in another embodiment and in a corresponding sectional view;

FIG. 13 the transport nozzle array as in FIG. 11, sectioned along line XIII-XIII of FIG. 11, in a partially perspective representation and in a cutout; and FIG. 14 a partially cut open plan view of a long storage machine as in FIG. 1, in a modified embodiment as a multi-rope machine.

The long storage machine shown in FIGS. 1 to 3 is disposed for the treatment of strand-shaped textile material in the form of a continuous material rope that is circulated at least during part of the treatment.

The machine comprises an elongated, substantially tubular treatment container 1 that consists of a longer cylindrical tubular section 2 and a shorter, likewise cylindrical, tubular section 3 having the same diameter, these being connected to each other via a wedge-shaped intermediate tubular piece 4 and being closed on the end sides with bottoms, for example torispherical ends or basket elbow ends 5, 6. The removably mounted basket elbow end 6 is provided with a loading door 7 leading into the interior of the container. The axes of the two tubular sections 2, 3 include between them an oblique angle of 165 degrees. On its front end, the treatment container 1 is supported by two feet 8 mounted to opposite sides on the tubular section 3, said feet being supported by stationary bearing brackets 10 so that it can be pivoted about a horizontal axis of rotation 9.

On the back end of the treatment container 1, there is provided lifting device that is schematically represented at 11 and is in contact with the outside of the longer tubular section 2, said lifting device working with a not specifically illustrated lifting spindle or with likewise not illustrated lifting cylinders and forming adjustment means for the treatment container 1. By means of the lifting device 11, it is possible to pivot the treatment container 1 about its axis of rotation 9, so that the inclination of the treatment container is changed relative to the horizontal, for example, between the position as in FIG. 1 in which the short tubular section 3 is oriented approximately parallel to the horizontal and the position as in FIG. 2 in which the substantially straight center part 2*a* of the longer tubular section adjoining the intermediate tubular piece 4 is either oriented exactly parallel or at a smaller residual inclination relative to the horizontal. As can be inferred from FIGS. 1, 2, an end part of the longer tubular section 2*b* of the longer tubular section 2 bearing the torispherical end 5 is pivoted upward relative to the adjoining tubular section 2*a* about a small axial angle of approximately 10 degrees, so that—in the lowered position of the treatment container as in FIG. 2—fluid contained in said treatment container gathers on the container bottom at a lowest point 12 in the region of the intermediate tubular piece 4 and can be removed from this lowest point.

As a rule, the inclination of the treatment container 1 is adjustable by appropriate pivoting about the axis of rotation 9 within a range of 6 degrees to 14 degrees; however, in the event of special cases of use, other, in particular larger, adjustment ranges are also conceivable. In its respectively set position of inclination, the treatment container 1 can be locked by adjustment means of the lifting device 11 as is indicated by catches 13. The adjustment of the inclination of the treatment container 1 may also be done in a continuous manner.

In the treatment container 1, as is particularly obvious from FIG. 3, there are arranged a transport nozzle array 14, an adjoining transport section 15 and a trough-shaped or tub-shaped, elongated gliding bottom 16, these allowing that a continuous material rope schematically indicated at 17 in FIGS. 4, 5 can be put into circulation. The material rope sucked up by the transport nozzle array 14 moves through the transport section 15 to the material rope inlet side 18 (FIG. 4) of a storage section 210 of the treatment container 1 accommodating a folded material rope pile as indicated at 19, in which treatment container extends—from the material rope inlet side 18 to a material rope outlet side 20 (FIG. 5)—the gliding bottom 16 receiving the folded material rope pile 19.

The gliding bottom 16 extends in the treatment container 1 at a distance above the container wall 21 located below and is firmly supported by holders 22 mounted to the container wall. If the inclination of the treatment container is changed by being pivoted about the axis of rotation 9, consequently also the inclination of the gliding bottom 16 is correspondingly changed relative to the horizontal. Alternatively, other embodiments are also conceivable, wherein also the gliding bottom 16 in the treatment container 1 is supported by holders 22 that are height-adjustable and thus allow a changing of the inclination of the gliding bottom 16 relative to the container wall 21, while the treatment container 1 itself maintains its once-set inclination.

The tub-shaped gliding bottom 16, which is provided on its inside walls facing the passing-through material rope pile 19 and displays a low coefficient of friction relative to the material rope pile and is coated—for example with Teflon—or provided with special gliding elements or rollers, is made of two walls with a fluid-impermeable outside wall 23 and—at a distance therefrom—an inside wall 24 that is perforated in a section 24*a* extending from the material rope inlet side 18 and in a section 24*b* leading to the material rope outlet side 20 and is fluid-impermeable in a wall section 24*c* located in between. The perforated sections 24*a*, 24*b* are highlighted in black in FIG. 3. On their ends, there are provided fluid discharge openings 25 (FIGS. 4, 5) that are closed by closure caps 26 which can be selectively opened in order to be able to drain treatment fluid passing through the perforated inside wall sections 24*a*, 24*b* into the treatment container 1.

A filling pipe 260 terminates in the tub-shaped gliding bottom 16 and allows filling of the gliding bottom in the course of a treatment container adjustment as in FIG. 2 with treatment fluid, in which case the gliding bottom is oriented essentially in horizontal direction and the closure caps 26 are closed. Filled treatment fluid can ultimately be drained through a discharge opening 27 into the interior of the container. The fluid passage through the discharge opening 27 is controlled by a closure member 28 in such a manner that it can be actuated by an actuator 29 that can be controlled from the outside.

The gliding bottom 16 is curved concavely along is length that accommodates the material rope pile 19, preferably consistent with an arc of a circle having a large radius (for example 20 meters) or consistent with a catenary line. In so doing, the discharge opening 27 is arranged at the lowest point of the gliding bottom 16 with the gliding bottom being oriented horizontally. Adjoining this concavely curved section, the gliding bottom 16 is highly arched on the material rope inlet side 18 and on the material rope outlet side 20 at 16*a* and 16*b*, respectively, in which case the high arch 16*a* extends into the region of the center axis of the treatment container. The adjoining bordering edge of the lateral wall of the tub-shaped gliding bottom 16 is indicated at 30.

The transport section 15 above the gliding bottom 16 in the treatment container 1 comprises a transport tube 31, the details of which can be seen in FIGS. 6, 7, in particular. Starting at a short, straight tubular section 31*a* having a constant square diameter and being connected to the transport nozzle array 31, the transport tube 31 has, in a long section 31*b*, a conical expansion of the flow channel formed by the transport tube, with the cross-sectional form of said channel thus becoming increasingly rectangular. On the end of the transport tube section 31*b* facing the transport nozzle array 14, there follows a material rope outlet elbow 32 having a rectangular cross-section, the details of said elbow being obvious from FIG. 8. The material stand outlet elbow 32 extends over approximately 90 degrees and is provided with a perforation 33 in the region of its lateral walls and in at least its radial outside wall. It terminates in the manner that can be inferred from FIG. 4 in the gliding bottom 16 on the material rope inlet side 18 of said gliding bottom. Below the perforated material rope outlet elbow 32 there is, in the gliding bottom 16, a material rope depositing zone 330 (FIG. 4) having a width corresponding approximately to the width of the gliding bottom 16 and having a depth that is only 150 mm to 200 mm. This depositing zone 330 is delimited toward the inside of the treatment container by a boundary wall 34 (FIG. 4) that is arcuate, extends over the width of the gliding bottom 16 and extends downward toward the inside wall 24*a* of the gliding bottom 16 up to a specified distance. The material rope depositing zone 330 is thus delimited on all four sides by walls, in which case the highly arched section 16*a* extends in lateral direction relatively closely to the material rope outlet elbow 32. The tube section 31*a* could also be configured so as to have a constant rectangular of polygonal cross-section.

Feeding of the material rope on the back side of the material rope depositing zone 330 over the height of approximately 150 mm to 200 mm—together with the boundary wall 34—imparts a pulse to the material rope 17 moving into the gliding bottom 16, said pulse causing the material rope to be deposited at the beginning of the storage section in super-imposed layered folds in such a manner that the material rope 17 on the material rope outlet side 20 is always drawn off the uppermost layer 17*a* of the material rope pile as is illustrated in FIG. 5. As indicated in FIGS. 4, 5, the material rope pile 19 is constructed on the material rope inlet side 18 in such a manner that later deposited textile material comes to lie under the fold of the previously deposited textile material, i.e., the folds of the rope in the material rope pile 19 are arranged so as to be inclined toward the material rope inlet side 18 and remain in this basic position when passing through the storage section. In this manner an excellent material rope movement is achieved while—when the material rope is being drawn off on the material rope outlet side 20—there is no risk that undesirable material rope loops, etc., are forming.

On entering the material rope depositing zone 330 the material rope 17 is folded across the width of the tub-shaped gliding bottom 16 such that the material rope outlet elbow 32 is imparted with an oscillating uniform movement via the transport tube 31. For this purpose, the transport tube is supported so that it can be pivoted together with the transport nozzle array 14 about an axis of rotation 340 (FIGS. 5, 9) extending through a straight tube connecting piece 35 of the treatment agent supply line 470 to the transport nozzle array 14. The tube connecting piece 35 is rotatably supported in a sealed manner at 36 in a rotating bearing mounted to the treatment container 1. The pivot range of the transport tube 31 can be inferred from FIG. 9, where, on the side with the transport tube 31 in a center position, the two end positions of the transport tube 31 located on both sides of this center position are illustrated, while the pivot range is indicated by an arrow 37.

Due to the relatively great length of the transport tube 31, the material rope outlet elbow 32 leads to a uniform, almost linear movement across the width of the depositing zone 330 during the material rope depositing process. As a result of this, a very gentle deposition of the material rope in the depositing zone 330 is achieved, which is of advantage with highly sensitive textile materials, in particular. This is in contrast with such known embodiments of folding arrangements wherein a material rope outlet elbow is imparted with a rotary movement about the axis of the transport tube that causes a corresponding twisting of the material rope that passes through, thus potentially resulting in difficulties affecting a variety of sensitive textile materials.

The oscillating pivoting motion is applied to the transport tube 31 by a drive motor 38 (FIG. 3) attached to the treatment container 1, said motor being connected via a link mechanism 39 in such a manner that the transport tube 31 is moved back and forth at uniform speed over its pivot range 37.

As a result of the fact that the entire transport section 15 is arranged together with the transport nozzle array 14 inside the treatment container 1, there results the advantage that the transport tube 31 does not need to be pressure-resistant and thus can be manufactured in a relatively simple and cost-effective manner. As can be learned from FIG. 3, the transport section 15 and the transport nozzle array 14 may be configured with height dimensions that are so minimal that these can be removed and inserted again through the opened loading opening at 7.

With its tubular section 31*a* having a constant square cross-section along its length, the transport section 15 is connected to a transport nozzle 40 of the transport nozzle array 15, the precise design of which can be inferred from FIGS. 10 through 13, in particular:

Attached to the tubular section 31*a* is a cylindrical housing panel 41 that is peripherally shiftable in an axially delimited manner and is moved sealed in a fluid-tight manner by gaskets 42 in a housing ring flange 43 of a nozzle housing 44. The ring flange 43 has an inlet opening 45 for the treatment fluid that can flow via a tubular elbow 460 of the treatment fluid supply line 470 (FIG. 5) into the nozzle housing 44. Extending into the nozzle housing 44 is the tubular section 31*a* having a square cross-section, said section 31*a* being provided—at an axial distance from the housing panel 41—on the edge side—with four straight nozzle elements 46 (FIGS. 11, 13). Each of the nozzle elements 46 is substantially bent in a semi-cylindrical form and extends over the length of the lateral wall of the tubular section 31*a*, in which case the four nozzle elements 46 are connected to each other at the ends in a manner obvious from FIG. 13 so as to abut against each other. Thus results a nozzle opening 47 that is delimited in a straight line on all sides by cylindrical surfaces. In alignment with this nozzle inlet opening 47 is the outlet part 48 of a funnel-shaped material rope inlet elbow 49 leading into the nozzle housing 44 and being connected therewith in a fluid-tight manner, said outlet part being appropriately adapted in view of its dimensions and having a square cross-section. The material rope inlet elbow 49 has an essentially rectangular material rope inlet opening 50 that is also delimited by essentially semi-cylindrically bent guide surfaces 51, as can be seen in FIGS. 10, 11.

Between the nozzle elements 46 having the semi-cylindrical cross-section and surrounding the nozzle inlet opening 47 and the outlet part 48, there is delimited a nozzle gap 52 via which the treatment fluid fed through the treatment fluid supply line enters into the tubular section 31*a* of the transport tube 31. Due to the cylindrical form of the nozzle elements 46 and the configuration of the material rope outlet opening of the outlet part 47 adapted so said form, an essentially eddy-free introduction of the treatment fluid through the conical nozzle gap 52 into the nozzle inlet opening 47 is achieved. In contrast with the conditions of a design of the nozzle gap delimited by more or less parallel surfaces or the abrupt embodiment of the nozzle gap, in this case largely laminar flow conditions are achieved that—even at high treatment temperatures—avoid cavitations or similar phenomena that are detrimental to the transport of the material rope.

The opening width of the nozzle gap 52 can be adjusted in that, in the embodiment as in FIG. 11, the entire transport section 15 is axially adjusted in the direction of the arrow 53. For this purpose, an adjustment mechanism 54 (FIG. 10) is provided on the transport nozzle 40, said adjustment mechanism comprising an L-shaped adjustment lever 56 having a ring flange 43 a pivotally supported at 55, the respectively selected angular position of said adjustment lever being lockable in place by means of catches 57. The adjustment lever 56 is connected, via a clip 58 forming a part of the adjustment mechanism in a hinged manner, to the tube section 31*a* in such a manner that a pivoting movement of the adjustment lever 56 about the pivot axis at 55 is effected by an axial oscillation of the tube section 31*a* as indicated by the arrow 53, and thus the entire transport tube 31.

The adjustment lever 56 may be manually actuated or via a not specifically illustrated actuator of a control device. It allows the selective changing of the nozzle gap 52 that tapers conically toward the outlet opening from the nozzle housing 44. In this manner, it is possible to change the intensity of the treatment of the passing material rope with the treatment fluid between a more intensive treatment (narrow nozzle gap) and a more gentle treatment (large nozzle gap).

In an alternative embodiment illustrated by FIG. 12, the nozzle housing 44 can be adjusted back and forth in tube axis direction consistent with the arrow 53*a* for the adjustment of the nozzle gap 52 relative to the transport tube 31—and thus its tube piece 31*a*—that cannot be adjusted back and forth in axial direction. The corresponding adjustment mechanism is not specifically illustrated in FIG. 12. Basically, its design is similar to that shown by FIG. 10. Other than that, parts that are the same as or similar to those in FIG. 11 have the same reference signs, so that—to this extent—it is not necessary to explain them again. In this case, the inlet opening 45 is arranged in the housing panel 41. The embodiment of FIG. 11, as well as that of FIG. 12, is provided with an anti-twist protection between the housing panel 41 and the ring flange 43 so that a twisting between the parts 48 and 46, 31*a* delimiting the nozzle gap 52 may not occur.

The long storage machine described so far operates as follows:

In the known long storage machines, most textile materials are treated at a relatively long bath ratio of, e.g., 1:8 to 1:15, which necessitates great expenses and effort in view of energy, chemicals and reactive dyes.

As opposed to this, the hydraulically operating long storage machine is designed for the smallest possible bath ratios that are on the order of 1:3 for synthetic materials and of 1:4 for cotton materials.

The material rope 17 to be treated is introduced in a customary manner—with the treatment door 7 open—into the treatment container that is designed as a pressure-resistant vat and, in so doing, said material rope is sucked through the materials rope inlet elbow 49 by the transport nozzle array 14. The transport nozzle array 14 is loaded with treatment fluid that, among other things, is optionally evacuated by a pump 60 via a drain line 59 (FIG. 3) originating at 12 from the treatment container, which container has a rotary feedthrough 90 having an axis of rotation 9 arranged in one of the two feet 8. The pump 60 conveys the treatment fluid over a heat exchanger 61 and a lint filter 62 of the bath supply line 470 to the transport nozzle array 14. The tube connection between the supply line 470 and the pressure side of the pump 60 occurs via a rotary feedthrough having an axis of rotation 9 arranged in one of the feet 8, which is not specifically illustrated in the drawing (FIG. 3), while the drain line 59 is connected to the suction side of the pump 60 via the rotary feedthrough 90. The treatment agent addition vessels and arrangements are not specifically illustrated.

After the ends of the rope have been sewn to each other and after closing the loading door 7, the material rope 17 may be treated in the—optionally pressurized—treatment container 1 with the treatment fluid that has been brought to the required temperature. In so doing, the long storage machine allows the operation—depending on the requirements of the textile material—in wet mode, in semidry mode or in dry mode.

The material rope is circulated by the transport nozzle array 14, transported through the transport section to the material rope inlet side 18 into the treatment container 1 and introduced there into the tub-shaped gliding bottom 16 via the material rope outlet elbow 32 in the depositing zone 330, where said material rope is stored in the storage section in the form of the material rope pile 19 and conveyed to the material rope outlet side 20. Here, it is again sucked into the transport nozzle array 14 after having passed through the so-called draw-off height.

Downstream of the transport nozzle 40 of the transport nozzle array 14, the material rope first moves through the tube piece 31*a* having a constant cross-section and a length approximately five to ten times the width of the nozzle inlet opening 47. In this zone, the pulse of the treatment agent jet is applied at a high degree of efficiency to the textile material of the material pile. The pulling forces generated by the jet of the treatment fluid act on the passing material pile over a length of approximately 600 to 1000 mm with the result that a highly gentle treatment of the textile material with low pulling forces can be achieved.

Adjoining this intensive zone in the tube piece 31*a*, the transport tube 31 widens conically in its tube section 31*b*. In this tube section, the remaining flow energy of the treatment medium is transmitted to the material rope. At the same time, the textile material is opened through the conical expansion to the outlet width of the transport channel. The intensive zone in the tube section 31*a* and the conical expansion in the tube section 31*b* result in a very good pulling effect of the material rope transport system to act on the material rope. The low speed of the treatment fluid at the end of the transport section prevents impairments of the conveyed textile material, to which also contributes the circumstance that the pulling forces are transmitted to the material rope over a relatively long path of the transport section. The transport of the textile material in the transport tube 31 occurs in a floating manner. The transport section 15 is provided with an incline in order to bring the textile material to the upper position of the gliding bottom 16 and to the material slide created thereby. The cross-section of the transport tube 31 is rectangular which, compared with a cylindrical tube, provides the advantage that the textile material is not compressed on the tube bottom where it is supported, as is true of a cylindrical tube.

After passing through the transport tube 31, the textile rope enters the upper end of the perforated rectangular material rope outlet elbow 32 arranged on the upper end of the transport tube 31. Due to the centrifugal force and due to the residual pressure of the treatment agent, a large portion of the treatment agent carried along by the material rope is separated from the material rope and enters the back part of the treatment container 1. As the material rope velocity increases, a disproportionately large amount of the treatment agent is separated from the material rope. The released treatment agent splashes from the treatment outlet elbow 32 against the adjacent walls in the back part of the treatment container 1 and causes the cleaning of these walls in this manner. As a rule, the percentage of the thusly separated treatment fluid is at approximately 30 to 70%.

Below the perforated material rope outlet elbow 32, the material rope 17 enters the material rope depositing zone 330. This is relatively narrow and causes, in the already described manner, a controlled deposition of the material rope. Due to the special configuration of the walls and the boundary wall 34, the material rope is turned in such a manner while it is being deposited that, as already mentioned, the material rope is drawn off the uppermost fold 17*a* located at the lower end of the gliding bottom 16 on the material rope outlet side 20.

Treatment fluid that is still carried along is removed from the material rope pile 19 pushed forward on the gliding bottom 16 is discharged through the perforation in the gliding bottom sections 24*a*, 24*b* and allowed to flow off into the treatment container 1 with the flaps 26 open.

Combined with the short draw-off height of the material rope on the material rope outlet side 20, this low treatment fluid load of the material rope also results in a minimal pulling strength stress on the material rope on the way between the gliding bottom and the transport nozzle array 14. Inasmuch as the transport nozzle array 14 is not arranged in the ascending part of the material rope circulation path, i.e., adjoining the gliding bottom 16 and downstream of the material rope inlet elbow 49, but in the continuation of the straight tube section 31*a* of the transport section 14, highly favorable circulation conditions result for the material rope that is treated in a particularly gentle manner.

The textile material layer, i.e., the height of the material rope pile 19 on the gliding bottom 16, as a rule, ranges between 10 and 15 cm. In this manner, the compressive pressure acting at the lower end of the inclined gliding bottom 16 on the lowermost material rope fold is relatively low. As a result of the already described option of letting the free treatment fluid drop off, there is only the treatment fluid remaining in the loops or fabric interstices due to capillary action and adhesive forces. Therefore, the largest group of textile materials by far can be treated in the treatment container in the elevated position as in FIG. 1, in which the gliding bottom 16 is inclined accordingly. As a result of the uniformly curved shape of the gliding bottom 16, the density of the material rope pile—as has also already been explained—remains relatively low on the entire transport path through the storage section and this, in particular, also in the lower-lying region in the vicinity of the material rope outlet side 20.

Referring to a particular group of textile materials (e.g., acetate) the compression of the material rope pile on the gliding bottom 16 is already too high when the treatment container is adjusted as in FIG. 1, so that folds and creases or other surface detriments may occur. Considering this group of articles, the inclination of the treatment container 1 can be reduced into the position as in FIG. 2, so that the tub-shaped gliding bottom 16 is filled with treatment agent and the textile material is treated therein in a floating manner. The space under the gliding bottom 16 remains loaded with a gas/air vapor mixture below the perforated wall 24*a, b* because of the wall 23 that acts as a bath collector. Consequently, the bath ratio in this operating mode is considerably smaller than in conventional plants. Other than that, the inclination of the treatment container 1 can be selected consistent with the different coefficients of friction of various textile materials. If the tub-shaped gliding bottom 16 according to FIG. 2 is set approximately horizontally, the treatment agent discharge in this treatment is closed by the flaps 26 and by the drain valve 27. The amount of treatment fluid flowing through the material rope outlet elbow 32 into the gliding bottom 16 flows with the material rope pile to the material rope outlet side 20, where said fluid overflows over the raised edge 16*b* of the gliding bottom 16 in the treatment container.

Of course, all the functions of the new long storage machines, including the adjustment of the nozzle gap 52, can be automatically controlled by a control device. This is advantageous in commission dyeing and allows the new long storage machine to treat almost all virtually occurring groups and areas of different textile materials within a large spectrum.

As a rule, the nominal loading weights for a long storage machine are not reached with light-weight textile materials. In order to reach the nominal treatment weight and keep the material rope circulation time within acceptable limits the machine may be equipped with several transport tubes 31. in this case, a transport tube 31 as described hereinabove is equipped with a transport nozzle 40 having an adjustable nozzle gap 52, whereas the other transport tubes 31 can be dimensioned—optionally without adjustment—for lighter-weight textile materials; however, this is not absolutely necessary. FIG. 14 shows an exemplary embodiment of this type. Considering the embodiment that has been previously described with reference to FIGS. 1 to 4, the same parts are identified with the same reference signs and need not be explained again.

The new long storage machine was described hereinabove as a hydraulic machine, wherein the transport of the material rope 17 is performed solely by the treatment fluid, and wherein the associate transport nozzle array is configured accordingly. Basically however, it is also possible to apply the principle of the machine to long storage machines that operate pneumatically and/or mixed pneumatically/hydraulically. In these cases, the transport nozzle array 14 comprises transport nozzle means that can be charged either with a transport gas and/or with a transport gas as well as with a transport fluid, in which case treatment agents in a suitable form, for example atomized, may be added to the transport gas, as has been known per se.

An apparatus for the treatment of strand-like textile material in the form of a continuous rope which is circulated during at least part of its treatment comprises an elongated substantially tubular treatment container 1 having a storage section which holds a folded rope pile 19. The storage section. contains a gliding bottom 16 and means 11 for changing the incline of the gliding bottom 16 from its rope inlet side 18 to its rope outlet side.

The invention claimed is:

1. An apparatus for treatment of a strand-like textile material in the form of a continuous material rope, which is circulated during at least part of the treatment, the apparatus comprising:

an elongated, essentially tubular treatment container;

a transport nozzle array to which a transport medium flow can be applied; and a transport section adjoining the transport nozzle array, the transport section terminating on a material rope inlet side in a storage section of the treatment container, and the storage section accommodating a folded material rope pile, wherein the storage section comprises:

a gliding bottom extending at a distance above a container wall below, the gliding bottom extending from the material rope inlet side of the storage section to a material rope outlet side in vicinity of the transport nozzle array; and at least one unit provided for changing an inclination of the gliding bottom from the material rope inlet side toward the material rope outlet side, wherein the gliding bottom is configured in a shape of an elongated tub, a bottom of which is concavely curved, in at least some regions, in a longitudinal direction of the elongated tub, the gliding bottom comprising, in at least some regions, a fluid-permeable perforation, and wherein the apparatus comprises caps which are operable to selectively close off discharge from the fluid-permeable perforations in a fluid-tight manner.

2. The apparatus of claim 1, wherein the inclination of the gliding bottom can be changed together with the treatment container.

3. The apparatus of claim 2, wherein:

the treatment container is supported so that it can be rotated about an axis of rotation; and at least one adjustment unit is allocated to the container, by which the container can be fixed in a respectively adjusted angular position.

4. The apparatus of claim 3, wherein the axis of rotation is arranged in a region of a treatment agent supply line or a drain line arrangement of the treatment container.

5. The apparatus of claim 4, wherein the treatment agent supply line or drain line arrangement comprises a rotary feedthrough which comprises the axis of rotation.

6. The apparatus of claim 1, wherein the transport section is arranged in the treatment container above the gliding bottom.

7. The apparatus of claim 6, wherein the transport section is arranged so as to ascend over a part of its length from the material rope inlet side toward the material rope outlet side.

8. The apparatus of claim 6, wherein the transport section, on an end facing the material rope inlet side, comprises a material rope outlet elbow for guiding the material rope on the gliding bottom, and a wall of the material rope outlet elbow is provided with at least one lateral treatment agent passage.

9. The apparatus of claim 8, wherein a material rope depositing zone is provided on the gliding bottom in a region below the material rope outlet elbow.

10. The apparatus of claim 9, wherein the material rope depositing zone is delimited toward an interior of the container by a boundary wall configured such that a folded deposited material rope of a respectively last deposited part of the material rope is located on top on the material rope outlet side.

11. The apparatus of claim 1, wherein the bottom of the gliding bottom is curved, in at least some regions, in a form of an arc of a circle.

12. The apparatus of claim 1, wherein the bottom of the gliding bottom is curved, in at least some regions, in a form of a catenary line.

13. The apparatus of claim 1, wherein the tub can be oriented at least in a substantially horizontal manner.

14. The apparatus of claim 1, wherein the transport section on the material outlet side terminates at a small distance directly above the tub.

15. The apparatus of claim 14, wherein the transport section comprises a material rope inlet elbow arranged above the tub, and the transport nozzle array is located in a part of the transport section adjoining the material rope inlet elbow.

16. The apparatus of claim 1, wherein the transport section is supported so that it can be pivoted about a pivot axis located in a region of the transport nozzle array and extending transversely to the gliding bottom.

17. The apparatus of claim 16, wherein the transport section is coupled with a pivoting device imparting the transport section with a substantially linear pivoting motion.

18. The apparatus of claim 1, wherein the transport section comprises a transport tube comprising at least a polygonal cross-section.

19. The apparatus of claim 18, wherein the transport tube is square or rectangular in cross-section.

20. The apparatus of claim 1, wherein the transport nozzle array comprises a transport nozzle with an adjustable nozzle gap for a transport medium.

21. The apparatus of claim 20, wherein the nozzle gap is delimited all around by a plurality of straight nozzle elements that essentially have a partially cylindrical cross-sectional form.

22. The apparatus of claim 21, wherein the nozzle gap is configured to conically taper in a direction of the transport medium flow.

23. The apparatus of claim 18, wherein the transport tube further comprises, adjoining a nozzle gap, a tube section comprising a constant cross-section.

24. The apparatus of claim 23, wherein the transport tube still further comprises, adjoining the tube section with the constant cross-section, a tube section that expands laterally in a conical manner.

25. The apparatus of claim 1, further comprising:

a plurality of transport sections arranged next to each other; and a plurality of transport nozzle arrays allocated to the plurality of transport sections.

* * * * *